US008946569B2

(12) United States Patent
Li

(10) Patent No.: US 8,946,569 B2
(45) Date of Patent: Feb. 3, 2015

(54) MULTI-DIRECTIONAL BUTTON ASSEMBLY AND ELECTRONIC DEVICE

(75) Inventor: Chuan-Sheng Li, New Taipei (TW)

(73) Assignee: Wistron Corporation, New Taipei (TW)

( * ) Notice: Subject to any disclaimer, the term of this patent is extended or adjusted under 35 U.S.C. 154(b) by 154 days.

(21) Appl. No.: 13/610,380

(22) Filed: Sep. 11, 2012

(65) Prior Publication Data

US 2013/0161174 A1 Jun. 27, 2013

(30) Foreign Application Priority Data

Dec. 21, 2011 (TW) ..... 100147824 A

(51) Int. Cl.
*H01H 13/72* (2006.01)

(52) U.S. Cl.
USPC ..... 200/5 R; 200/341; 200/344

(58) Field of Classification Search
CPC ..... H01H 13/72; H01H 9/26
USPC ..... 200/341, 5 B, 314, 5 E, 6 A
See application file for complete search history.

(56) References Cited

U.S. PATENT DOCUMENTS 6,703,571 B2 * 3/2004 Nishimoto et al. ..... 200/6 A
6,841,743 B2 * 1/2005 Okada et al. ..... 200/6 A
7,269,439 B2 9/2007 Honda
7,288,732 B2 * 10/2007 Hashida ..... 200/5 A
7,426,338 B2 * 9/2008 Matsumoto et al. ..... 396/25
7,442,886 B2 * 10/2008 Hashida ..... 200/5 R
7,511,235 B2 * 3/2009 Osada ..... 200/6 A
8,228,162 B2 * 7/2012 Yoshihara et al. ..... 338/47

FOREIGN PATENT DOCUMENTS

TW M272156 8/2005
TW M330550 4/2008
TW M364907 9/2009
TW M364907 U 9/2009
TW M370169 12/2009

OTHER PUBLICATIONS

Taiwanese Office Action dated Apr. 25, 2014, as issued in corresponding Taiwan Patent Application No. 100147824 (with English translation).

* cited by examiner

*Primary Examiner* — Renee S Luebke
*Assistant Examiner* — Ahmed Saeed
(74) *Attorney, Agent, or Firm* — Muncy, Geissler, Olds & Lowe, P.C.

(57) ABSTRACT

A multi-directional button assembly includes a first switch, a second switch, a support piece, a pressing slice, a center button body, and a directional button body. The first switch and the second switch respectively provide a first trigger point and a second trigger point to be pressed to generate a first trigger signal and a second trigger signal. The support piece is disposed above the first switch and includes an aperture corresponding to the first trigger point. The pressing slice extends from the support piece to a position above the second switch. The center button body includes an extension post and is pressed for driving the extension post to press the first trigger point via the aperture. The directional button body is disposed above the pressing slice and is pressed to bias the pressing slice to press the second trigger point without pressing the first trigger point.

18 Claims, 10 Drawing Sheets

MULTI-DIRECTIONAL BUTTON ASSEMBLY AND ELECTRONIC DEVICE

CROSS-REFERENCES TO RELATED APPLICATIONS

This non-provisional application claims priority under 35 U.S.C. §119(a) on Patent Application No. 100147824 filed in Taiwan, R.O.C. on Dec. 21, 2011, the entire contents of which are hereby incorporated by reference.

BACKGROUND OF THE INVENTION

1. Technical Field

The present invention relates to a multi-directional button assembly, and more particularly to a multi-directional button assembly that significantly prevents misoperation from occurring.

2. Related Art

Most of the commercially available portable electronic devices, such as mobile phone, tablet computer, electronic book or media player, have physical buttons with which a user may operate the electronic device. The physical buttons can provide the user with the practical feel of pressing. Although the electronic device has a touch screen to replace the physical buttons, the physical buttons remain disposed on the electronic device.

A typical multi-directional button assembly, in addition to a directional button body (left/right buttons or up/down buttons), is also disposed with one center button body in the central part, so as to provide multiple operational directions. In the prior art, the directional button body corresponding to multiple directions is usually disposed as a plurality of single units. For example, in the Taiwan Utility Model Patent M370169, a multi-directional button assembly is disclosed, in which five button bodies are provided to correspond to five operational directions. Each button body requires different moulds for production and fabrication, so the cost is increased and assembly becomes more difficult.

Additionally, the multi-directional button body is integrally formed. A corresponding direction is changed according to a different position pressed by a user. Examples are disclosed in the U.S. Pat. No. 7,269,439, Taiwan Utility Model M330550, Taiwan Utility Model M272156, and Taiwan Utility Model M364907. However, when an integrally formed multi-directional button body is pressed and biased to trigger the corresponding switch, a switch corresponding to the center button body is also easily triggered by mistake. Conversely, when the center button body biases to the direction of being pressed, a switch corresponding to the directional button body is also easily triggered by mistake, so the probability of misoperation is increased.

SUMMARY

A directional button body of a multi-directional button in the prior art is usually disposed in a separated manner, and has a complicated structure. When the directional button body adopts an integrally formed multi-directional button, misoperation can easily occur due to false touch.

Accordingly, this disclosure proposes a multi-directional button assembly, which has a simple structure and solves the misoperation problem due to false touch for the integrally formed directional button body.

This disclosure proposes a multi-directional button assembly, which includes a first switch, at least one second switch, a support piece, at least one pressing slice, a center button body, and a directional button body.

The first switch provides a first trigger point to be pressed to generate a first trigger signal. The second switch is spaced from the first switch. The second switch provides a second trigger point to be pressed to generate a second trigger signal.

The support piece is disposed on the first switch without contacting the first trigger point. The support piece further includes an aperture corresponding to the first trigger point. The pressing slice extends from the support piece to a position above the second switch.

The center button body is disposed above the support piece and the center button body further includes an extension post for passing through the aperture of the support piece. The center button body is to be pressed to drive the extension post to press the first trigger point via the aperture. The directional button body is disposed on the pressing slice to be pressed, so as to bias the pressing slice to press the second trigger point without contacting the first trigger point.

Separated by the support piece, the directional button body in actuation does not contact the first switch. Meanwhile, the center button body in actuation also does not cause the pressing slice to bias, thus preventing the misoperation problem.

This disclosure further proposes an electronic device, which includes a housing and a multi-directional button assembly.

The housing has an opening. The multi-directional button assembly is disposed in the opening of the housing. The multi-directional button assembly includes a first switch, at least one second switch, a support piece, at least one pressing slice, a center button body, and a directional button body.

The first switch provides a first trigger point to be pressed to generate a first trigger signal. The second switch is spaced from the first switch and the second switch provides a second trigger point to be pressed to generate a second trigger signal.

The support piece is disposed on the first switch without contacting the first trigger point. Additionally, the support piece includes an aperture corresponding to the first trigger point. The pressing slice extends from the support piece to a position above the second switch.

The center button body is disposed above the support piece and the center button body further includes an extension post for passing through the aperture of the support piece. The center button body is to be pressed to drive the extension post to press the first trigger point via the aperture. The directional button body is disposed above the pressing slice. The directional button body is to be pressed to bias the pressing slice, so that the pressing slice presses the second trigger point without contacting the first trigger point.

With the connection of the support piece and the pressing slice, it is ensured that the center button body in actuation drives the extension post to pass through the aperture without making the pressing slice bias to trigger the second trigger point by mistake. The directional button body in actuation directly biases the pressing slice to trigger the second trigger point without making the support piece contact the first trigger point. Even though the directional button body presses the support piece, the trigger first trigger point is not triggered. Therefore, the multi-directional button assembly prevents the misoperation problem. An integrally formed directional button body which corresponds to multiple directions at the same time also simplifies the structure of the multi-directional button assembly of the present invention.

The detailed features and advantages of the present invention are described below in great detail through the following embodiments, the content of the detailed description is sufficient for those skilled in the art to understand the technical content of the present invention and to implement the present invention there accordingly. On the basis of the content of the specification, the claims, and the drawings, those skilled in the art can easily understand the relevant objectives and advantages of the present invention.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
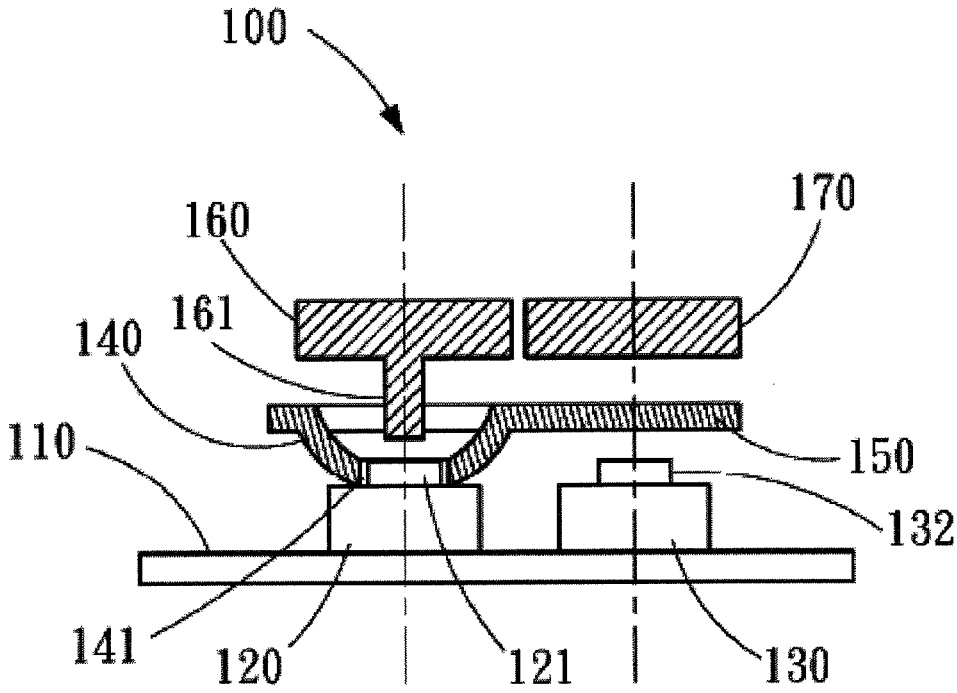
FIG. 1 is a cross-sectional view according to a first embodiment.

FIG. 1 shows a multi-directional button assembly 100 according to a first embodiment. The multi-directional button assembly 100 includes a substrate 110, a first switch 120, a second switch 130, a support piece 140, a pressing slice 150, a center button body 160, and a directional button body 170.

As shown in FIG. 1, the first switch 120 is disposed on the substrate 110 and provides a first trigger point 121. The first trigger point 121 is to be pressed to enable the first switch 120 to generate a first trigger signal. The second switch 130 is also disposed on the substrate 110 and spaced from the first switch 120. The second switch 130 provides a second trigger point 132 and the second trigger point 132 is to be pressed to generate a second trigger signal.

The substrate 110 is usually a printed circuit board, and especially a main circuit board of an electronic device 600. In other examples, the substrate 110 is a common board configured with wires. The substrate 110 is used for providing electricity to the first switch 120 and the second switch 130 and transfer the signals generated by the first switch 120 and the second switch 130. In one example, the first switch 120 and the second switch 130 are micro switches. The first switch 120 and the second switch 130 are fixed on the substrate 110 in a welded manner to establish electrical connections to transfer a first trigger signal and a second trigger signal to the substrate 110.

As shown in FIG. 1, the support piece 140 is disposed above the first switch 120 without contacting the first trigger point 121. The support piece 140 further includes an aperture 141 corresponding to the first trigger point 121. In one example, the support piece 140 is a semispherical body. The aperture 141 penetrates a bottom of the semispherical body. The bottom of the semispherical body is disposed on the first switch 120 and the first trigger point 121 is located in the aperture 141. Therefore, when being pressed or biased, the semispherical body (support piece 140), is kept from contact with the first trigger point 121.

As shown in FIG. 1, the pressing slice 150 extends from the support piece 140 and further extends to a position above the second switch 130. The pressing slice 150 is normally kept at an interval from the second trigger point 132. In one example, the support piece 140 and the pressing slice 150 is integrally formed.

Figure 2:
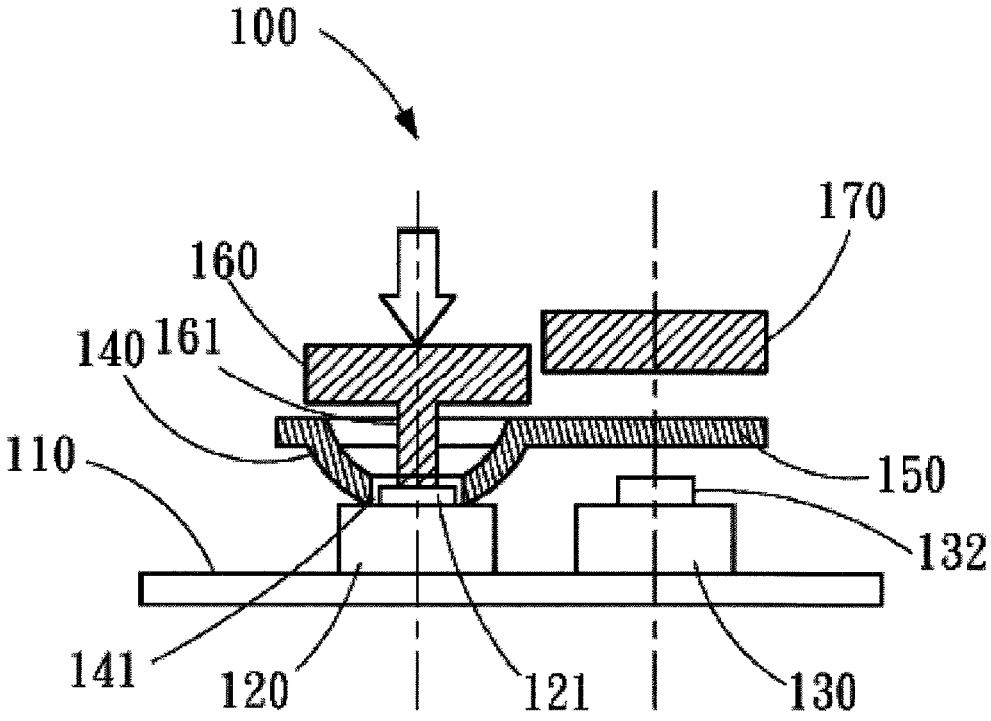
FIG. 2 and FIG. 3 are cross-sectional views according to the first embodiment, which disclose the actuation of the center button body and the directional button body, respectively.

As shown in FIG. 1 and FIG. 2, the center button body 160 is disposed above the support piece 140. The center button body 160 further includes an extension post 161 for passing through the aperture 141 of the support piece 140. An interval is normally kept between the center button body 160 and the support piece 140. An end of the extension post 161 is usually kept at an interval from the first trigger point 121. In the example that the first switch 120 is a micro-switch, the extension post 161 may be slightly in contact with the first trigger point 121. The center button body 160 is to be pressed to drive the extension post 161 to pass through the aperture 141, such that the extension post 161 presses the first trigger point 121 via the aperture 141 to trigger the first switch 120 to generate a first trigger signal.

Figure 3:
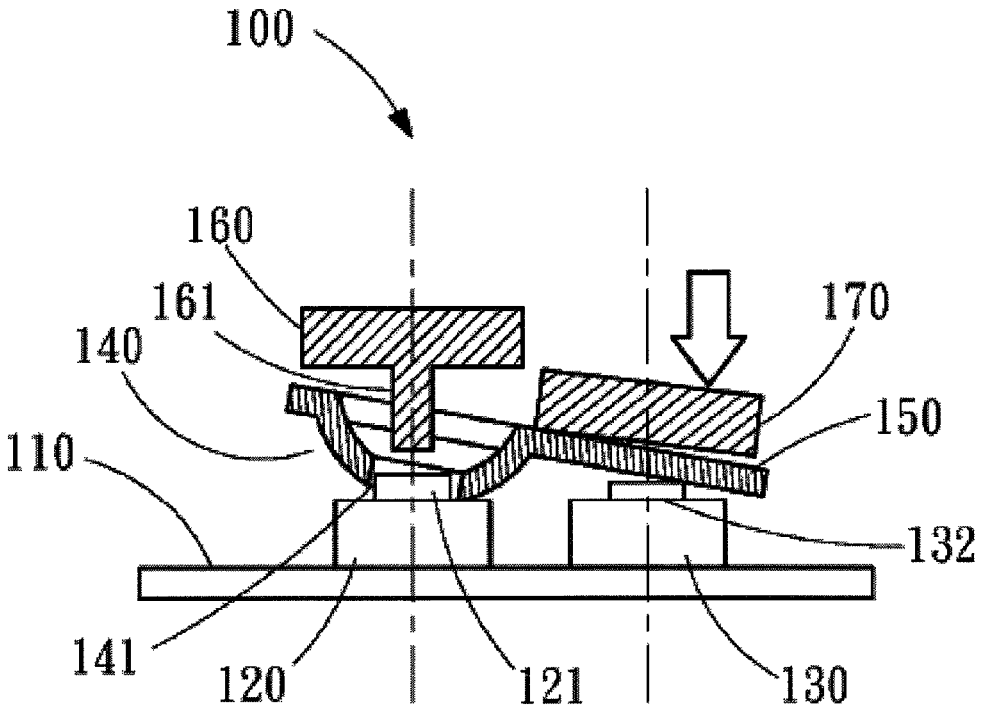

As shown in FIG. 1 and FIG. 3, the directional button body 170 is disposed above the pressing slice 150. The directional button body 170 is normally kept at an interval from the pressing slice 150. Alternatively, the directional button body 170 is slightly in contact with pressing slice 150. The directional button body 170 is to be pressed to bias the pressing slice 150, so that the pressing slice 150 presses the second trigger point 132 to trigger the second switch 130 to generate a second trigger signal without contacting the first trigger point 121. The pressing slice 150 is biased with the support piece 140 as a fulcrum and the pressing slice 150 sways downwards to bias. Alternatively, elastic deformation occurs to the pressing slice 150 due to an applied force, so a front end of the pressing slice 150 biases downwards.

In this disclosure, with the connections of the support piece 140 and the pressing slice 150, it is ensured that the center button body 160 in actuation drives the extension post 161 to pass through the aperture 141 without making the pressing slice 150 bias to trigger the second trigger point 132 by mistake. The directional button body 170 in actuation directly biases the pressing slice 150 to trigger the second trigger point 132 while keeping the support piece 140 from contact with the first trigger point 121. Even though the directional button body 170 presses the support piece 140, the trigger first trigger point 121 is not triggered. Therefore, the misoperation problem of the multi-directional button assembly 100 may be avoided.

Figure 4:
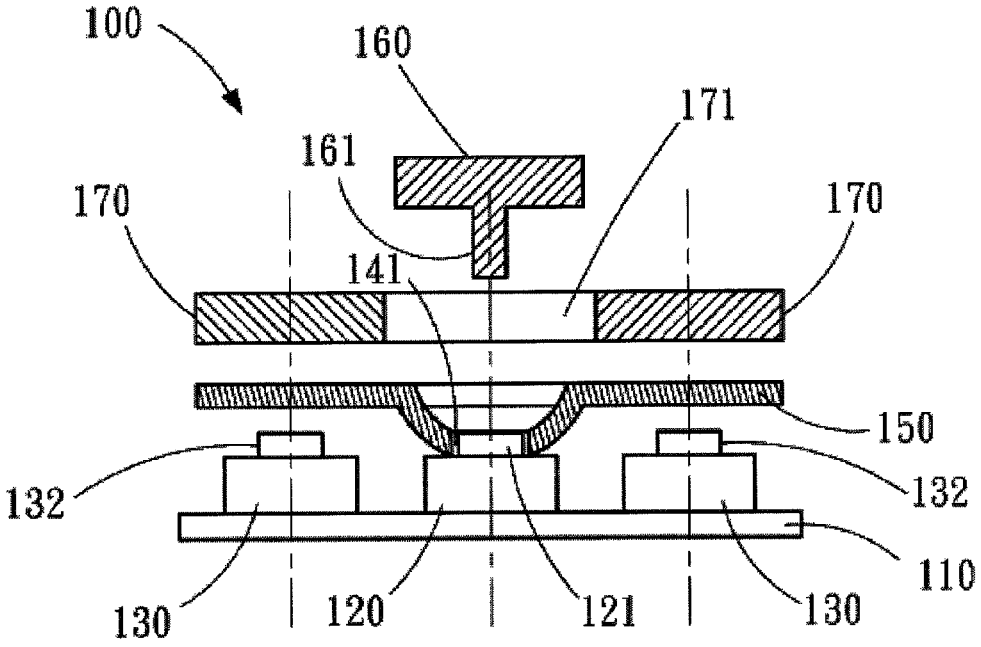
FIG. 4 is a cross-sectional view according to a second embodiment.

FIG. 4 shows a multi-directional button assembly 100 disclosed in a second embodiment, which includes a substrate 110, a first switch 120, a plurality of second switches 130, a support piece 140, a plurality of pressing slices 150, a center button body 160, and a directional button body 170. The differences between the first embodiment and the second embodiment are addressed as follows.

In the second embodiment, the second switches 130 are spaced from the first switch 120, respectively. At this time, the second trigger point 132 of each second switch 130 is to be separately pressed to enable each corresponding second switch 130 to separately generate a second trigger signal.

Each pressing slice 150 respectively extends from the support piece 140. Each pressing slice 150 respectively extends to one position above one of the second switches 130. In one example, all the pressing slices 150 and the support piece 140 are integrated into a single sheet.

The directional button body 170 is located above each of the pressing slices 150 at the same time. And the directional button body 170 surrounds the center button body 160. In one example, the directional button body 170 has a receiving hole 171 and the center button body 160 is located in the receiving hole 171. As with the previously described first embodiment, the directional button body 170 is to be pressed to bias towards a specific direction, so to bias the pressing slice 150 in the corresponding biasing direction. As a result, the specific pressing slice 150 presses the corresponding second trigger point 132 to trigger the corresponding second switch 130 to generate a second trigger signal without triggering the first trigger point 121. Conversely, when the center button body 160 is pressed, the pressing slice 150 does not bias to trigger the second trigger point 132 by mistake. The multi-directional button assembly 100 in this embodiment prevents the misoperation problem according to the same principle in the first embodiment.

Figure 5:
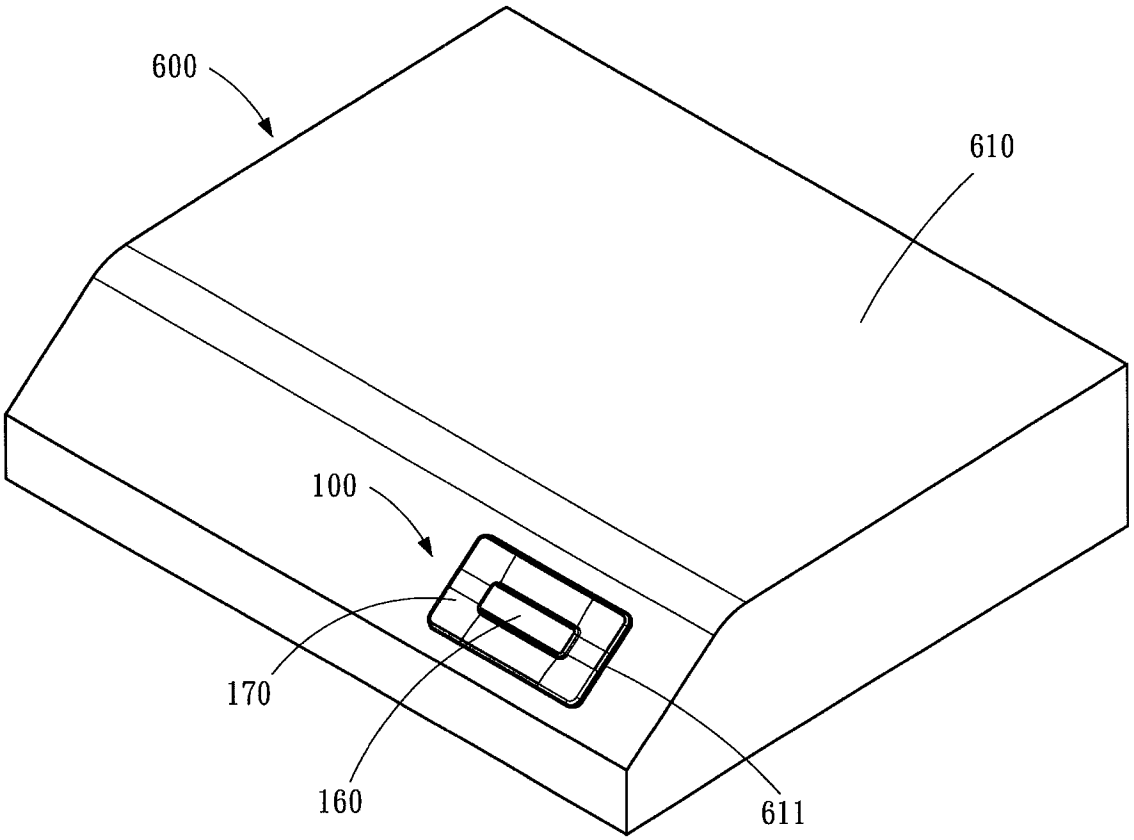
FIG. 5 is a perspective view according to a third embodiment.
Figure 6:
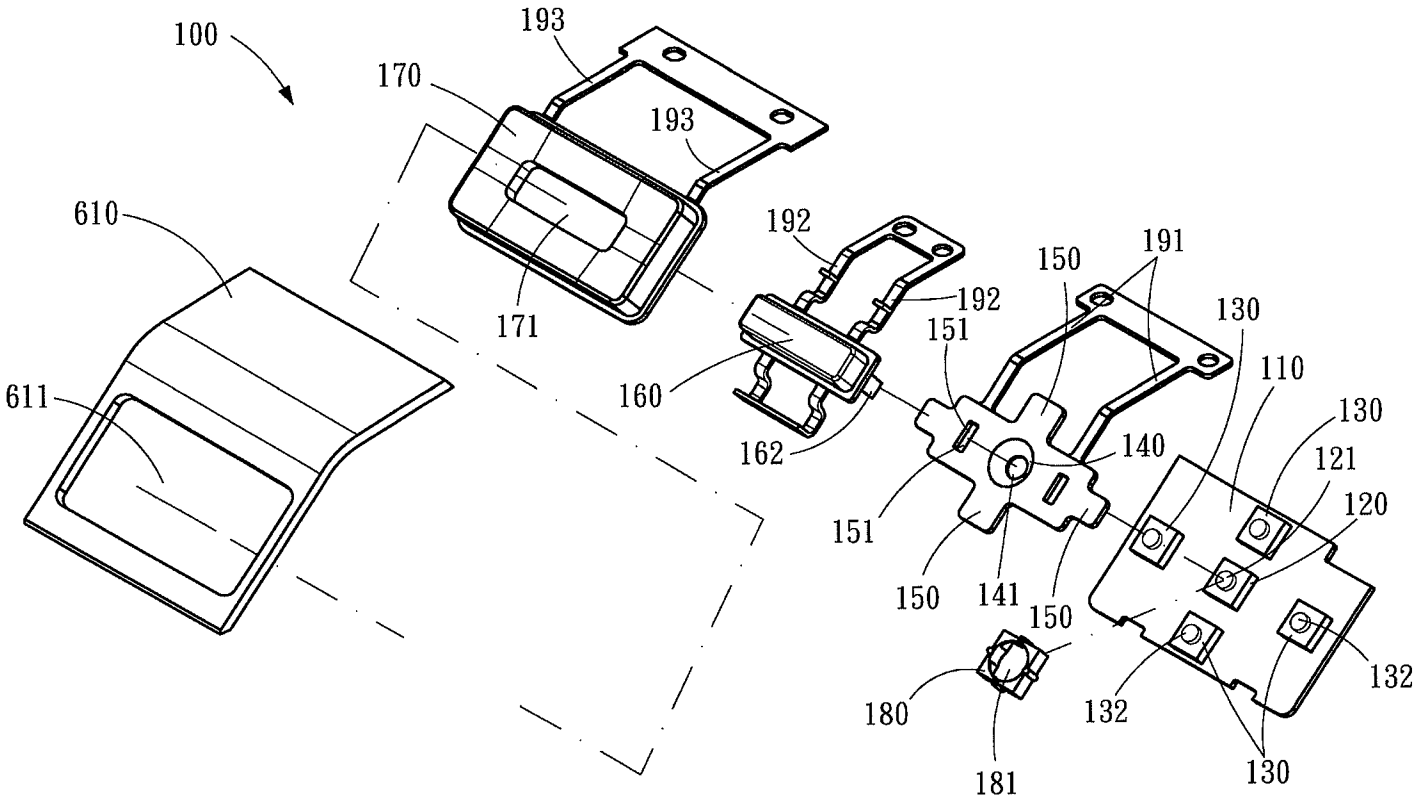
FIG. 6 and FIG. 7 are exploded views according to the third embodiment.
Figure 7:
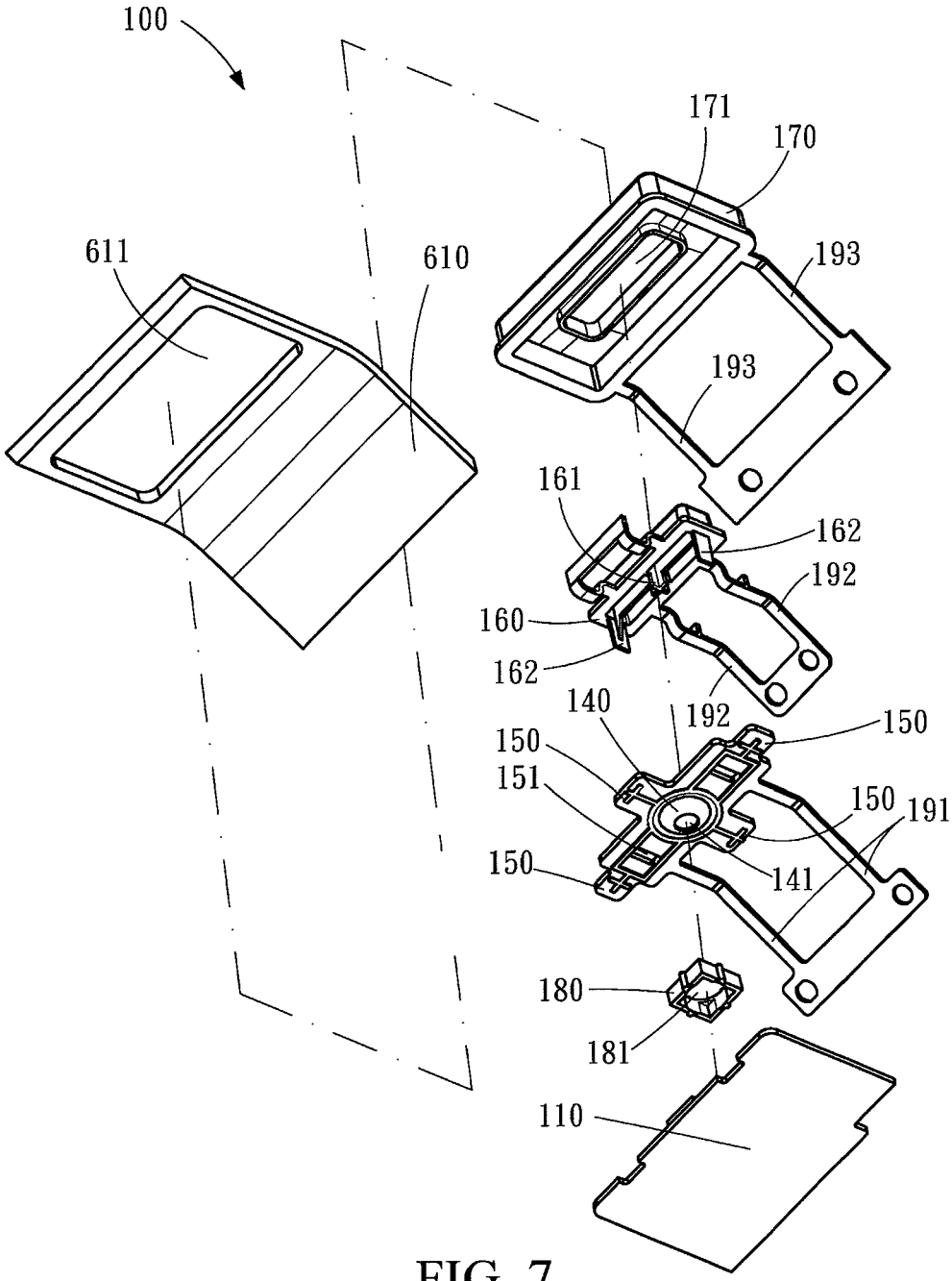

FIG. 5, FIG. 6, and FIG. 7 show a multi-directional button assembly 100 disclosed in a third embodiment. The multi-directional button assembly 100 includes a substrate 110, a first switch 120, a plurality of second switches 130, a support piece 140, a plurality of pressing slices 150, a center button body 160, and a directional button body 170.

As shown in FIG. 6 and FIG. 7, the first switch 120 and the second switches 130 are disposed on the substrate 110. The second switches 130 are disposed around the first switch 120, so that the first switch 120 is located at a central position of an area surrounded by the second switches 130. Each second switch 130 is spaced from the first switch 120, respectively. The four second switches 130 in the drawings are only exemplary, and the practical number of the second switches 130 can be changed according to the demand of the number of operational directions. For example, eight second switches 130 are used to coordinate with the operations of eight directions.

The first switch 120 provides a first trigger point 121 to be pressed to trigger the first switch 120 to generate a first trigger signal. Each second switch 130 provides a second trigger point 132, respectively. The second trigger point 132 of each second switch 130 is to be separately pressed to enable each second switch 130 to separately generate a second trigger signal. In one example of an electronic device 600, the second trigger signal is a signal that indicates an up, down, left or right direction. The first trigger signal is a signal that indicates selection and confirmation.

Figure 8:
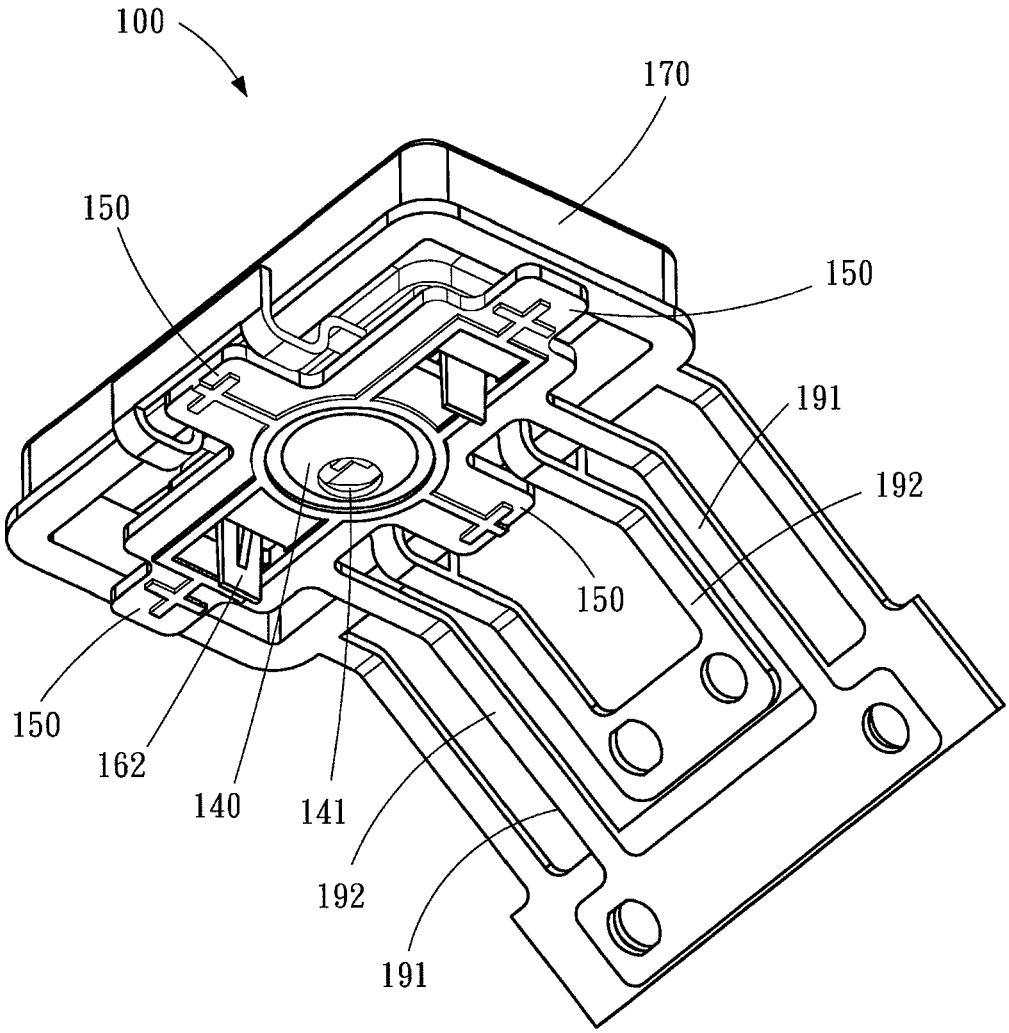
FIG. 8 and FIG. 9 are perspective views of a part of elements according to the third embodiment.
Figure 9:
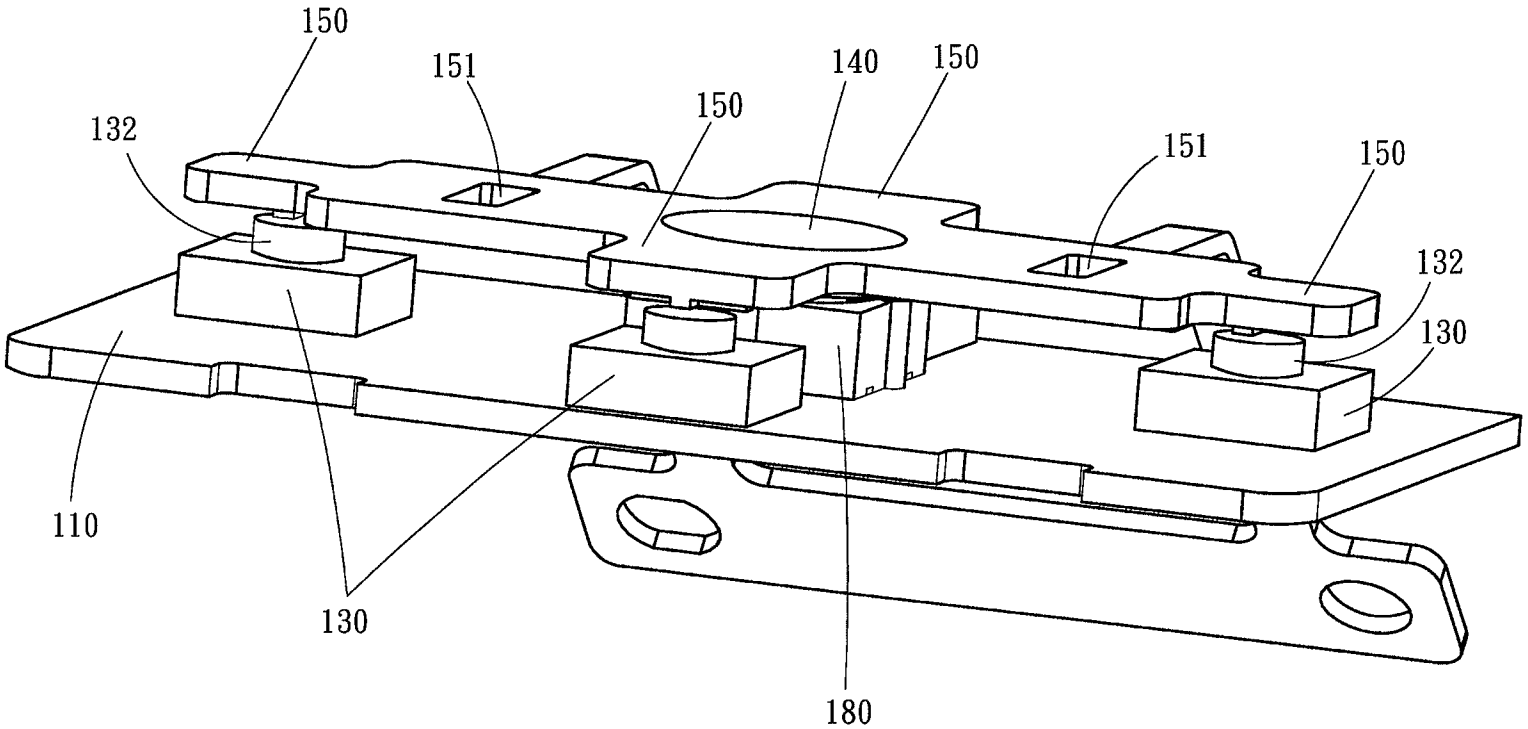
Figure 10:
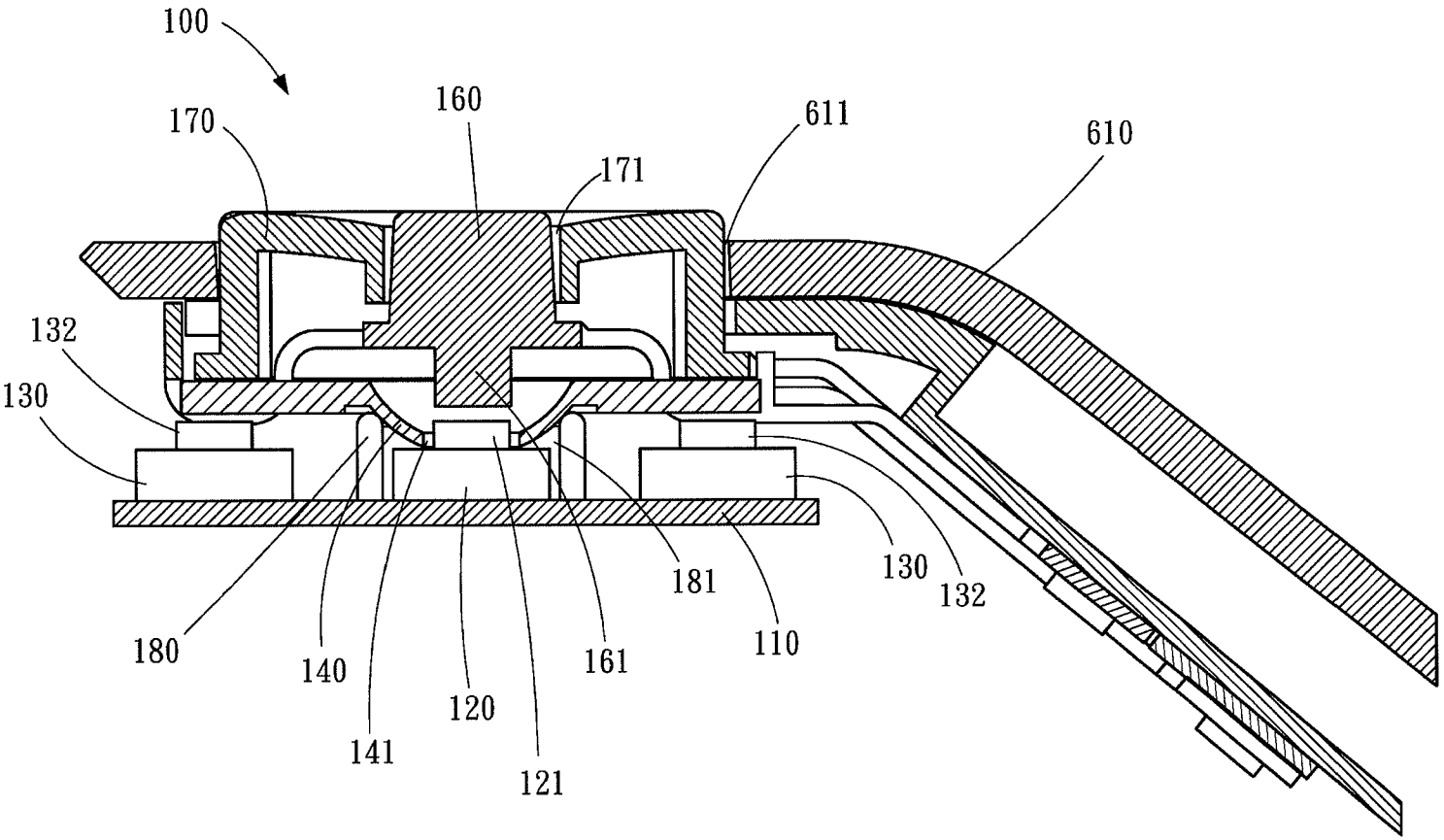
FIG. 10 is a cross-sectional view according to the third embodiment.

As shown in FIG. 6, FIG. 7, and FIG. 8, the support piece 140 is disposed on the first switch 120. However, the support piece 140 is not in contact with the first trigger point 121. In one example, the support piece 140 is a semispherical body and the support piece 140 further includes an aperture 141 located at a bottom of the semispherical body and corresponding to the first trigger point 121.

As shown in FIG. 6 and FIG. 7, each of the pressing slices 150 extend from the support piece 140 to one position above one of the second switches 130, so that each pressing slice 150 corresponds to one of the second switches 130, respectively. And each of the pressing slices 150 is normally kept at an interval from the corresponding second trigger point 132. Each pressing slice 150 is used to be pressed to bias to press the corresponding second trigger point 132 to trigger the second switch 130. In one example, all the pressing slices 150 and the support piece 140 are integrated into a single sheet.

As shown in FIG. 6, FIG. 7, FIG. 9, and FIG. 10, the multi-directional button assembly 100 further includes a bearing seat 180 disposed on the substrate 110. The bearing seat 180 has a bearing hole 181 and the first switch 120 is located in the bearing hole 181. An inner diameter of the bearing hole 181 is smaller than a maximum outer diameter of the support piece 140 (semispherical body), so that the bearing hole 181 receives the support piece 140 and bear the support piece 140 on the bearing seat 180.

As shown in FIG. 6, FIG. 7, FIG. 9, and FIG. 10, the center button body 160 is disposed above the support piece 140 and is slightly in contact with or is not in contact with the support piece 140. The center button body 160 further includes an extension post 161 for passing through the aperture 141 of the support piece 140. The center button body 160 is to be pressed, so that the extension post 161 presses the first trigger point 121 to trigger the first switch 120 to send a first trigger signal.

The directional button body 170 is a cubic structure with an approximate rectangular shape and has a receiving hole 171. The receiving hole 171 has a rectangular cross-section. The center button body 160 is a cubic structure with a rectangular shape, which is disposed corresponding to the shape and size of the receiving hole 171. It should be noted that the directional button body 170 and the center button body 160 do not have to be rectangular at the same time, and may also be various combination of inner and outer shapes in which the directional button body 170 is rectangular and the center button body 160 is circular or the directional button body 170 is circular and the center button body 160 is circular. The center button body 160 is located in the receiving hole 171, so that the directional button body 170 is disposed surrounding the center button body 160. The directional button body 170 is disposed on the pressing slices 150 and is to be pressed to bias one of the pressing slices 150, so that the pressing slice 150 presses the corresponding second trigger point 132 to trigger the second switch 130 to send a second trigger signal.

In one example that the first switch 120 and the second switch 130 are micro switches, when a first trigger 121 point and a second trigger point 132 are pressed under a force, the first switch 120 and the second switch 130 are then triggered to send a first trigger signal and a second trigger signal. Consequently, in the first, second and third embodiments of this disclosure, the recovery mechanisms for the pressing slice 150, the center button body 160, and the directional button body 170 may be omitted. However, in the case that the first switch 120 and the second switch 130 have other forms, the extension post 161 of the center button body 160 must be normally kept at an interval from the first trigger point 121 and the pressing slice 150 also must be normally kept at an interval from the second trigger point 132.

As shown in FIG. 6, FIG. 7, FIG. 8, and FIG. 10, the multi-directional button assembly 100 in the third embodiment further includes a plurality of recovery elements 191, 192, and 193, which are connected to the pressing slices 150, the center button body 160, and the directional button body 170, respectively, so as to restore the aforementioned parts at the original positions when the pressing slices 150, the center button body 160, and the directional button body 170 are subject to no force. As a result, the first trigger point 121 and the second trigger point 132 are kept in the state of being not triggered.

As shown in FIG. 6, FIG. 7, FIG. 8, and FIG. 10, a positioning hole 151 is opened on the at least one pressing slice 150. The center button body 160 further includes one or more positioning posts 162. Each positioning post 162 passes through one positioning hole 151. The combination of the positioning post 162 and the positioning hole 151 enables the center button body 160 to displace towards the first switch 120 along a straight line when being pressed and avoids the horizontal displacement of the center button body 160 to accidentally bias the pressing slice 150.

As shown in FIG. 5, FIG. 6, FIG. 7, and FIG. 10, the multi-directional button assembly 100 is disposed in a housing 610 of an electronic device 600. That is, the electronic device 600 includes the housing 610 and a multi-directional button assembly 100. The housing 610 has an opening 611. The multi-directional button assembly 100 is disposed in the opening 611 of the housing 610, so that the substrate 110, the first switch 120, the second switch 130, the support piece 140, and the pressing slice 150 of the multi-directional button assembly 100 are disposed in the housing 610, whereas the center button body 160 and the directional button body 170 are located in the opening 611. The substrate 110 may be a main circuit board of the electronic device 600 or independent from the main circuit board, and is electrically connected to the main circuit board.

One end of each of the recovery elements 191, 192, and 193 are connected to an inside surface of the housing 610 and the other end is respectively connected to the pressing slice 150, the center button body 160, and the directional button body 170. When the pressing slice 150, the center button body 160, and the directional button body 170 are subject to no force, the pressing slice 150, the center button body 160, and the directional button body 170 can restore to the original positions, whereas the first trigger point 121 and the second trigger point 132 are kept at a state of being not triggered.

In this disclosure, with the connections of the support piece 140 and the pressing slice 150, it is ensured that the center button body 160 in actuation drives the extension post 161 to pass through the aperture 141 without biasing the pressing slice 150 to trigger the second trigger point 132 by mistake. The directional button body 170 in actuation directly biases the pressing slice 150. Even though the directional button body 170 presses the support piece 140, the trigger first trigger point 121 is not triggered. Therefore, the multi-directional button assembly 100 prevents the misoperation problem. At this time, the directional button body 170 is disposed as a single element rather than that button bodies need to be disposed for individual directions one by one, so the button bodies can be disposed in a simpler manner.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A multi-directional button assembly, comprising:

a first switch, for providing a first trigger point to be pressed to generate a first trigger signal;

at least one second switch, spaced from the first switch, and for providing a second trigger point to be pressed to generate a second trigger signal;

a support piece, disposed above the first switch without contacting the first trigger point, and further comprising an aperture corresponding to the first trigger point, wherein the support piece is a semispherical body, and the aperture penetrates a bottom of the semispherical body;

at least one pressing slice, extending from the support piece to a position above the second switch;

a center button body, disposed above the support piece, and comprising an extension post for passing through the aperture of the support piece, wherein the center button body is provided for being pressed to drive the extension post to press the first trigger point via the aperture; and a directional button body, disposed above the pressing slice, for being pressed to bias the pressing slice to press the second trigger point without contacting the first trigger point.

2. The multi-directional button assembly as claimed in claim 1, further comprising a substrate, wherein the first switch and the second switch are disposed on the substrate.

3. The multi-directional button assembly as claimed in claim 2, wherein the multi-directional button assembly comprises a plurality of pressing slices and a plurality of second switches, and each pressing slice respectively extends from the support piece to one position above one of the second switches.

4. The multi-directional button assembly as claimed in claim 3, wherein the directional button body is located above each of the pressing slices at the same time, and the directional button body surrounds the center button body.

5. The multi-directional button assembly as claimed in claim 4, wherein the directional button body has a receiving hole, while the center button body is located in the receiving hole.

6. The multi-directional button assembly as claimed in claim 1, wherein the bottom of the semispherical body is disposed above the first switch and the first trigger point is located in the aperture.

7. The multi-directional button assembly as claimed in claim 1, further comprising a bearing seat disposed on the substrate, wherein the bearing seat comprises a bearing hole for receiving the support piece and bearing the support piece on the bearing seat.

8. The multi-directional button assembly as claimed in claim 1, wherein a positioning hole is opened on the pressing slice, and the center button body further comprises at least one positioning post passing through the positioning hole.

9. The multi-directional button assembly as claimed in claim 8, further comprising a plurality of recovery elements, respectively connected to the pressing slice, the center button body, and the directional button body, and used for restoring the pressing slice, the center button body, and the directional button body to original positions when the pressing slice, the center button body, and the directional button body are subject to no force.

10. An electronic device, comprising:

a housing, having an opening; and a multi-directional button assembly, disposed in the opening of the housing, and comprising:

a first switch, for providing a first trigger point to be pressed to generate a first trigger signal;

at least one second switch, spaced from the first switch, and for providing a second trigger point to be pressed to generate a second trigger signal;

a support piece, which is a semispherical body, disposed on the first switch without contacting the first trigger point, wherein the support piece further comprises an aperture penetrating a bottom of the semispherical body and corresponding to the first trigger point;

at least one pressing slice, extending from the support piece to a position above the second switch;

a center button body, disposed on the support piece, further comprising an extension post for passing through the aperture of the support piece, wherein the center button body is provided be pressed to drive the extension post to press the first trigger point via the aperture; and a directional button body, disposed on the pressing slice, for being pressed to bias the pressing slice to press the second trigger point without contacting the first trigger point.

11. The electronic device as claimed in claim 10, wherein the multi-directional button assembly further comprises a substrate, and the first switch and the second switch are disposed on the substrate.

12. The electronic device as claimed in claim 11, wherein the multi-directional button assembly comprises a plurality of pressing slices and a plurality of second switches, each pressing slice respectively extends from the support piece to one position above one of the second switches.

13. The electronic device as claimed in claim 12, wherein the directional button body is located above each of the pressing slices at the same time, and the directional button body surrounds the center button body.

14. The electronic device as claimed in claim 13, wherein the directional button body comprises a receiving hole, and the center button body is located in the receiving hole.

15. The electronic device as claimed in claim 10, wherein the bottom of the semispherical body is disposed on the first switch, and the first trigger point is located in the aperture.

16. The electronic device as claimed in claim 10, further comprising a bearing seat, disposed on the substrate, and having a bearing hole for receiving the support piece and bearing the support piece on the bearing seat.

17. The electronic device as claimed in claim 10, wherein a positioning hole is disposed on the pressing slice; and the center button body further comprises at least one positioning post passing through the positioning hole.

18. The electronic device as claimed in claim 17, further comprising a plurality of recovery elements, respectively connected to the pressing slice, the center button body, and the directional button body, and used for restoring the pressing slice, the center button body, and the directional button body to original positions when the pressing slice, the center button body, and the directional button body are subject to no force.

* * * * *